US006890122B1

(12) United States Patent
Nielsen

(10) Patent No.: US 6,890,122 B1
(45) Date of Patent: May 10, 2005

(54) HIGHWAY MARKER DEVICE

(75) Inventor: Murry R. Nielsen, Elk Point (CA)

(73) Assignee: Shamrock Valley Enterprises Ltd., Elk Point (CA)

( * ) Notice: Subject to any disclaimer, the term of this patent is extended or adjusted under 35 U.S.C. 154(b) by 2 days.

(21) Appl. No.: 10/724,439

(22) Filed: Nov. 28, 2003

(51) Int. Cl.[7] ..... E01F 9/011
(52) U.S. Cl. ..... 404/10; 40/608; 40/612; 116/63 P
(58) Field of Search ..... 404/6, 9, 10, 11; 256/1, 13.1; 116/63 P, 63 R; 40/607.01, 40/608, 612, 606.01

(56) References Cited

U.S. PATENT DOCUMENTS

| | | | | | |
|---|---|---|---|---|---|
| 884,105 | A | * | 4/1908 | Byerson et al. | 248/51 |
| 1,532,865 | A | * | 4/1925 | Beck | 404/11 |
| 1,903,739 | A | * | 4/1933 | Tatlock | 404/11 |
| 2,141,844 | A | | 12/1938 | Renzor | |
| 2,464,365 | A | | 3/1949 | Aves | |
| 3,847,497 | A | * | 11/1974 | Guillory, Sr. | 404/10 |
| 3,899,843 | A | * | 8/1975 | Doyle et al. | 40/602 |
| 4,270,873 | A | * | 6/1981 | Laehy et al. | 404/10 |
| 4,537,233 | A | * | 8/1985 | Vroonland et al. | 141/387 |
| 4,729,690 | A | * | 3/1988 | Lavender et al. | 404/10 |
| 4,886,232 | A | * | 12/1989 | Dicke et al. | 248/576 |
| 5,199,814 | A | * | 4/1993 | Clark et al. | 404/10 |

FOREIGN PATENT DOCUMENTS

| | | |
|---|---|---|
| CH | 142477 | 9/1930 |
| FR | 1311952 | 3/1963 |

* cited by examiner

*Primary Examiner*—Robert E. Pezzuto
*Assistant Examiner*—Alexandra K. Pechhold
(74) *Attorney, Agent, or Firm*—Terrence N. Kuharchuk; Rodman & Rodman

(57) ABSTRACT

A highway marker device is provided for marking the location of an object, such as a culvert, located adjacent to a highway. The marker device is comprised of a coil spring having a first end and a second end, wherein the coil spring is comprised of a plurality of windings around a spring axis. Further, a marker post is connected with the first end of the coil spring, wherein the marker post has a post axis and wherein the post axis is substantially perpendicular to the spring axis. Finally, the marker device is comprised of a mounting mechanism for connecting the device with the object such that the coil spring is substantially restrained from bending about the spring axis.

22 Claims, 5 Drawing Sheets

HIGHWAY MARKER DEVICE

FIELD OF INVENTION

The present invention relates to a highway marker device for marking the location of an object located adjacent to a highway, such as a culvert located adjacent to the highway.

BACKGROUND OF INVENTION

Various flagging or marking devices have been developed for indicating the location of an object at the side of a highway or roadway in order to enhance the visibility of the object or otherwise alert drivers on the highway of its position. There is a particular need for such devices where adverse weather conditions are encountered, such as where relatively large amounts of snow have accumulated at the side of the highway or the visibility of the object is otherwise reduced or impaired.

For example, where snow has accumulated at the side of the highway, the object may not be readily or apparently visible to an operator of snow removal equipment traveling along the highway. In this case, the snow removal equipment may collide with the object, such as a culvert at the side of the highway, causing damage to both the snow removal equipment and the object. Accordingly, it is desirable to provide a marking device or flag to indicate the location of the object such that the operator can avoid any collision with the object.

In addition, as accidental collisions with the marking device may occur, it is further desirable that the marking device not readily or easily break or fail upon collision with the vehicle traveling on the highway.

As stated, although various marking devices have been developed, none have been found to be fully satisfactory.

For instance, Swiss Patent No. 142477 published Sep. 30, 1930 by Amstutz shows a multi-component signaling device or marker incorporating a coiled spring. Specifically, a signaling post extends integrally up or vertically from a first end of the coiled spring, while a second end of the coiled spring acts as a bore for a tapered stake.

Similarly, French Patent No. 1,311,952 published Mar. 25, 1963 by Etablissements Vallette & Pavon also shows a multi-component signaling device incorporating a coiled spring. The coiled spring is provided with a vertically extending integral post at a first end. At a second end, the coiled spring tapers for one coil before vertically extending downwards for insertion into a bore on a stake for attachment to said stake via a nut.

In each of the above cases, the coil spring has an axis which extends parallel to the signaling post. As a result, in the event of any collision with the device, the signaling post and the coiled spring will tend to bend or twist about the axis of the coiled spring, which may increase the likelihood of breakage or failure of the device.

Further devices have been specifically developed for providing an audible signal to indicate the nearness of a vehicle to an object. Although these devices have a structure somewhat similar to the marking devices discussed above, they are unsuitable for use as highway marking devices.

For example, U.S. Pat. No. 2,141,844 issued Dec. 27, 1938 to Reznor relates to an obstruction detecting device that provides an audible warning to signal the approach to an object. For instance, the device may be applied to a vehicle to determine its proximity to a curb and in the case of a boat, to a pier. The device incorporates a coiled spring having an integral flexible reed-like arm at its first end and a clamp-like structure at its second end. The device is attached to a fixed part of the vehicle with the clamp-like structure. A hardened steel ball may be optionally attached to the end of the reed-like arm to impart the desired frequency to the vibratory system. Thus, contact between the flexible reed-like arm and an extraneous object will create a vibrational sound warning the driver of the proximity of the extraneous object.

Further, U.S. Pat. No. 2,464,365 issued Mar. 15, 1949 to Aves also relates to a device, attachable to an automobile, for indicating the nearness of a curb or a similar obstruction during parking operations. Specifically, the device utilizes vibrations set up by contact between the device and the obstruction to mechanically produce an audible sound within the vehicle. The device includes an open coil spring integral with an antenna at a first end and attached to a clamp at a second end. The antenna preferably extends from a first end of the coil diagonally downwardly and outwardly at an acute angle to the longitudinal axis of the coil and at an acute angle to a perpendicular obstruction surface. The tip of the antenna is in the form of a small closed loop or ball adapted to engage the obstruction. The open coil spring is specifically provided to amplify the sound that is produced on impact with the obstruction and also to prevent the antenna from becoming permanently deformed when deflected by the obstruction.

Thus, in the event of collision with each of the signaling devices of Reznor and Aves, each of the devices is mounted with the vehicle in a manner to provide for the bending of the coiled spring and the arm or antenna about the axis of the coiled spring. For instance, the flexible coiled spring and the flexible, reed-like arm of Reznor are specifically mounted and configured to provide for bending about the coiled spring axis and thereby prevent injury to the device upon contact with the obstruction. Similarly, the open coil spring of Aves is specifically mounted and configured to bend about its-axis in order to prevent the antenna from becoming permanently deformed when deflected by the obstruction. In each case, bending or twisting of the arm or antenna and the coiled spring about the axis of the coiled spring may increase the likelihood of breakage or failure of the device with repeated use.

Thus, there remains a need in the industry for an improved highway marker device for marking the location of an object located adjacent to a highway. Preferably, the marker device provides enhanced or improved visibility of the object and is capable of resisting breakage or failure upon collision of a vehicle with the marker device.

SUMMARY OF INVENTION

The present invention relates to a highway marker device for marking the location of an object located adjacent to a highway or roadway. The marker device is provided to enhance or improve the visibility of the object such that it is more readily or easily observable by users of the highway, such as a driver of a vehicle traveling on the highway. Further, the marker device is preferably adapted or configured to be capable of resisting breakage or failure upon the collision of a vehicle with the marker device, such as may occur accidentally during adverse weather conditions or conditions of reduced visibility, while minimizing or reducing any resulting damage to the vehicle caused by the marker device.

In a first aspect of the invention, the invention is comprised of a highway marker device for marking the location of an object located adjacent to a highway, the device comprising:

(a) a coil spring having a first end and a second end, wherein the coil spring is comprised of a plurality of windings around a spring axis;

(b) a marker post connected with the first end of the coil spring, wherein the marker post has a post axis and wherein the post axis is substantially perpendicular to the spring axis; and (c) a mounting mechanism for connecting the device with the object such that the coil spring is substantially restrained from bending about the spring axis.

The highway marker device is provided for marking, indicating or otherwise giving notice of the location or position of an object located adjacent to a highway. Although reference is made to a highway, the highway includes any type of road or roadway provided for vehicular travel. Further, the sides or edges of the road surface may have any grade. However, the marker device is particularly suited for use on low grade roads. Finally, although the marker device may be configured or adapted for placement at either side or edge of the highway relative to the direction of travel of the vehicles thereon, the marker device is particularly suited and provided for placement at the right side of the highway relative to the direction of travel of the vehicles.

Further, the marker device may mark the location of any type, manner or kind of object, thing or structure which is desired to be rendered more visible or observable from the highway. For instance, the marker device may be provided to mark the location of any object or structure which is typically installed or affixed adjacent, near or in relatively close proximity to the highway. In the preferred embodiment, the marker device is provided for marking the location or position of a culvert or other drain, channel or passage extending under the highway. Specifically, the culvert typically has at least one end or opening thereof which is located adjacent the highway.

Thus, in the preferred embodiment, the marker device marks the location of the end of the culvert adjacent the right side of the highway relative to the direction of travel of vehicles on the highway. Further, the marker device is most required for use where the highway is a relatively low grade road such that the uppermost surface of the end of the culvert is relatively close or near the road surface. In this instance, as a result of the low grade, the culvert is more likely to be contacted by a vehicle on the highway, particularly road maintenance equipment including snow removal equipment such as a snow plough. More particularly, the blade of the snow plough, which typically extends outwardly from the right side of the plough towards the shoulder or side of the highway, may accidentally contact or collide with the culvert during snow removal operations causing damage to the culvert. In this case, the marker device is provided to mark the location of the culvert for the operator of the snow plough so that a collision may be avoided.

As indicated, the highway marker device is comprised of a coil spring having a first end and a second end, wherein the coil spring is comprised of a plurality of windings around a spring axis. The coil spring may have any number of windings capable of performing the function of the coil spring as described herein. Preferably, the coil spring is comprised of at least 9 windings. However, in the preferred embodiment, the coil spring is comprised of at least 12 windings. Typically, the greater the number of windings, the greater the resiliency of the coil spring and the lesser the stress on the coil spring such that the likelihood of breakage or failure of the marker device is reduced upon contact or collision with the marker device. In other words, upon contact with the marker post, the coil spring permits the marker post to give or yield a desired amount to reduce the likelihood of breaking or snapping of the marker post and to reduce the likelihood or severity of any damage to the vehicle contacting the marker device.

Further, the coil spring may have any dimensions compatible with and suitable for the functioning of the coil spring and the device as described herein, the manner of connection of the device with the object and the mounting mechanism to be utilized for connecting the marker device with the object. In the preferred embodiment wherein the object is comprised of a culvert, the size and dimensions of the coil spring are selected, at least in part, to permit the coil spring to be placed within the culvert for connecting of the marker device with an inner surface of the culvert by the mounting mechanism. In the preferred embodiment, the coil spring has an outer diameter of at least about fifty millimeters.

Finally, the plurality of windings of the coil spring may be wound such that the coil spring may tend to either further wind or unwind, as desired, upon contact of the marker post with a vehicle moving in the direction of travel on the highway. For instance, the plurality of windings of the coil spring may be wound such that if the marker post is contacted by a vehicle moving in the direction of travel on the highway, the coil spring will tend to unwind. However, preferably, the plurality of windings of the coil spring are wound such that if the marker post is contacted by a vehicle moving in the direction of travel on the highway, the coil spring will tend to become more tightly wound. It is believed that the coil spring is subjected to less stress when the windings are more tightly wound on contact of the vehicle with the marker post, as compared with unwinding of the coil spring.

The marker post may be connected with the first end of the coil spring in any manner or by any mechanism, structure or means capable of forming, connecting, mounting or affixing the marker post with the coil spring such that the post axis of the marker post is substantially perpendicular to the spring axis. Further, the marker post may be fixedly or rigidly connected with the coil spring or the marker post may be removably or releasably connected with the coil spring. Where the marker post is removably or releasably connected with the coil spring, the marker post may be replaced as necessary or desired for maintenance or repair purposes or to vary the configuration or visibility of the marker post to render it more suitable for a particular use or conditions.

For instance, the marker device may be further comprised of a connector for connecting, mounting, affixing or fastening the marker post with the coil spring in the desired orientation. In this case, the connector may be comprised of a separate or distinct element or member which is positioned between and connects or fastens with each of the marker post and the coil spring such the post axis is substantially perpendicular to the spring axis. Alternately, the connector may be integrally formed with either the first end of the coil spring or an end of the marker post. In this instance, the connector is preferably integrally formed with the first end of the coil spring. As a result, when the device is connected with the object by the mounting mechanism, the marker post may still be interchanged as described above without requiring removal of the device from the object. The connector may be comprised of any type of mounting flange, connecting mechanism or fastener. The connecting mechanism may be comprised of a threaded connector providing a threaded connection between the adjacent ends of the coil spring and the marker post. The fastener may be comprised of one or more bolts or screws extending between the adjacent ends of the coil spring and the marker post.

Preferably, the first end of the coil spring is fixedly or non-releasably connected with the marker post. In the preferred embodiment, the marker post is integrally formed with the coil spring. Thus, the coil spring and the marker post are provided as an integral or complete unit.

The marker post may be coloured or coated as desired to improve the visibility of the marker post or to provide a visible cue or indication of a specific type of object being marked thereby. For instance, at least a portion of the marker post may be brightly coloured in order to enhance its visibility. In this case, one or more colours may be used as desired. Alternately, or in addition, at least a portion of the marker post may be coated with a luminous or fluorescent coating.

Finally, where desired, the marker device may be further comprised of a marker flag attached to the marker post. The marker flag may be comprised of any suitable flexible or rigid material and may have any suitable colour and dimensions for enhancing the visibility of the marker device. Alternatively or in addition, the marker flag may provide a warning or communicate a desired message to drivers of vehicles on the highway.

As indicated above, a mounting mechanism is provided for connecting the device with the object such that the coil spring is substantially restrained from bending about the spring axis. As a result, it is believed that the coil spring is subjected to less stress during use of the marker device, particularly upon collision or contact with a vehicle. Further, it is also believed that the mounting mechanism as described herein is also subjected to less stress during use of the marker device. As a result, the likelihood of breakage or failure of the marker device during use may be reduced.

The mounting mechanism may be comprised of any mechanism, device or structure, or combination of mechanisms, devices or structures, capable of connecting the device with the object such that the coil spring is substantially restrained from bending about the spring axis. However, preferably, the mounting mechanism is comprised of a primary mounting mechanism and wherein the primary mounting mechanism is preferably comprised of a mounting bracket located adjacent to the second end of the coil spring. However, the primary mounting mechanism may be comprised of any alternate mechanism, structure or device, or combination thereof, capable of substantially restraining the coil spring from bending about the spring axis and preferably located adjacent to the second end of the coil spring.

As indicated, the primary mounting mechanism is preferably comprised of a mounting bracket located adjacent to the second end of the coil spring, being either at or in close proximity to the second end. The mounting bracket may be comprised of a separate or distinct mounting element or member which is positioned at and releasably or removably connected or fastened with the second end of the coil spring. However, the mounting bracket is preferably fixedly or non-releasably connected, fastened or formed with the second end of the coil spring. In the preferred embodiment, the primary mounting mechanism is integrally formed with the coil spring. More particularly, the mounting bracket is integrally formed with the coil spring. Thus, the mounting bracket and the coil spring are provided as an integral or complete unit.

When connecting the mounting bracket with the object, the mounting bracket may be fixedly or non-releasably connected with the object. However, the marker device is preferably relatively easily or readily removable from the object as desired. Thus, the primary mounting mechanism is further preferably comprised of one or more fasteners for releasably or removably connecting the mounting bracket with the object, and thus connecting the marker device with the object. Each fastener may be comprised of any mechanism, structure or device capable of connecting the mounting bracket with the object such as a screw or bolt. In the preferred embodiment, the fastener is comprised of a bolt and compatible nut for connecting or affixing the mounting bracket with an adjacent surface of the object.

Further, the mounting bracket may be connected or integrally formed with the coil spring such that the mounting bracket may tend to move away or toward the object, as desired, upon contact of the marker post with a vehicle moving in the direction of travel on the highway. For instance, the mounting bracket may be connected or formed with the coil spring such that if the marker post is contacted by a vehicle moving in the direction of travel on the highway, the mounting bracket will tend to move away from the object. However, preferably, the mounting bracket is connected or formed with the coil spring such that if the marker post is contacted by a vehicle moving in the direction of travel on the highway, the mounting bracket will tend to move toward the object. It is believed that the coil spring and the primary mounting mechanism are subjected to less stress when the mounting bracket moves toward the object on contact of the vehicle with the marker post, as compared with movement away from the object.

Preferably, the mounting mechanism is further comprised of a secondary mounting mechanism and wherein the secondary mounting mechanism is axially spaced along the spring axis relative to the primary mounting mechanism so that the primary mounting mechanism and the secondary mounting mechanism together substantially restrain the coil spring from bending about the spring axis. The primary and secondary mounting mechanisms may be spaced apart any distance axially along the spring axis permitting the substantial restraint of the coil spring.

In the preferred embodiment, as indicated, the primary mounting mechanism is located adjacent to the second end of the coil spring. The secondary mounting mechanism may be located at any position axially along the spring axis between the primary mounting mechanism and the first end of the coil spring which permits or allows the primary and secondary mounting mechanisms to substantially restrain the coil spring from bending about the spring axis. Preferably, the secondary mounting mechanism is located adjacent to the first end of the coil spring, being either at or in close proximity to the first end. For instance, it has been found that placing the secondary mounting mechanism at the first end or alternatively within about 2 to 4 windings of the first end of the coil spring will substantially restrain the bending of the coil spring about the spring axis. Thus, in the preferred embodiment, the primary and secondary mounting mechanisms are located adjacent the second and first ends of the coil spring respectively to substantially restrain the coil spring from bending about the spring axis.

The secondary mounting mechanism may be comprised of any mechanism, structure or device, or combination thereof, capable of connecting the device with the object in a manner such that the secondary mounting mechanism assists or facilitates the primary mounting mechanism to substantially restrain the coil spring from bending about the spring axis. However, the secondary mounting mechanism is preferably comprised of one or more fasteners for connecting the coil spring with the object.

Each fastener may be comprised of any mechanism, structure or device capable of connecting the coil spring with the object, preferably adjacent the first end of the coil spring, such as a screw or nut. Preferably, the fastener is comprised of a U-bolt. Thus, in the preferred embodiment, the secondary mounting mechanism is comprised of a U-bolt which is sized to surround the coil spring. More particularly, the U-bolt is located at, adjacent or in proximity to the first end of the coil spring.

When connecting the U-bolt with the object to mount the marker device, the U-bolt may be fixedly or non-releasably connected with the object, such as by welding. However, as indicated previously, the marker device is preferably relatively easily or readily removable from the object as desired. Thus, the U-bolt is preferably releasably or removably connected with the object. Although the releasable connection may be provided by any releasable structure or removable connector, the secondary mounting mechanism is preferably further comprised of a pair of nuts for connecting the U-bolt with the object.

Each of the components or elements comprising the marker device, as described herein, may be comprised of any material suitable for and compatible with its intended function. For instance, the marker device, and any of its individual components, may be comprised of fibreglass, plastic or steel. However, preferably, at least the coil spring, the marker post and the mounting bracket are comprised of steel, such as spring steel. In the preferred embodiment, as discussed above, the coil spring, the marker post and the mounting bracket are integrally formed from a single piece of steel rod. Although the steel rod may have any suitable dimensions compatible with the intended use of the marker device, the steel rod preferably has a diameter of between about 10 millimeters and about 20 millimeters.

Finally, the marker device is preferably adapted to be connected with the object so that the spring axis is substantially perpendicular to a direction of travel on the highway. More preferably, the device is adapted to be connected with the object so that the spring axis is substantially horizontal.

SUMMARY OF DRAWINGS

Embodiments of the invention will now be described with reference to the accompanying drawings, in which.

DETAILED DESCRIPTION

Figure 2:
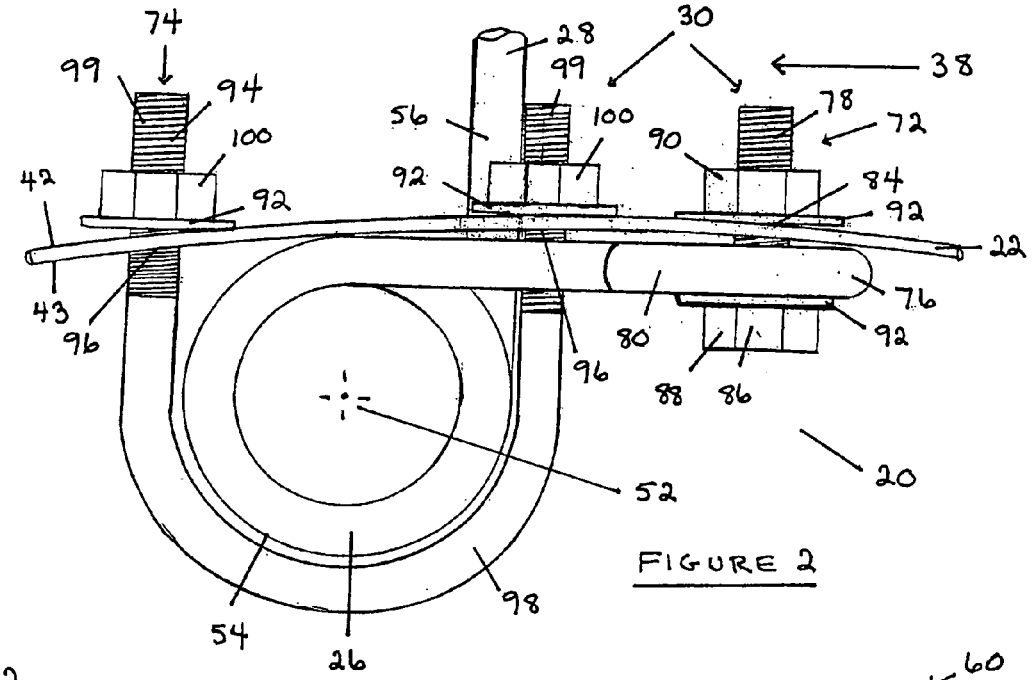
FIG. 2 is an end view of the highway marker device shown in FIG. 1 connected with the object shown in section, taken along line 2—2 of FIG. 1.

Referring to FIGS. 1–10, the invention relates to a highway marker device (20) for marking the location of an object (22) located adjacent to a highway (24). The marker device (20) is comprised of a coil spring (26), a marker post (28) and a mounting mechanism (30) for connecting the marker device (20) with the object (22).

The marker device (20) is provided to mark, indicate, give notice of or otherwise increase or enhance the visibility of the object (22) which is located adjacent, at or in proximity to the highway (24). More particularly, referring to FIG. 10, the highway (22) may be any type of road or roadway provided or intended for vehicular travel and having a road surface (32) and opposed sides or edges (34) of the road surface (32). Further, the sides or edges (34) of the road surface (32) may have any road grade (36), however, the preferred embodiment of the marker device (20) is particularly suited for use on relatively low grade (36) highways. In particular, due to the low grade (36) of the highway (24), the object (22) adjacent the highway (24) is more likely to be contacted by or to collide with vehicles travelling on the highway (24). Thus, these objects (22) are more likely to require the use of the within marker device (20) to enhance the visibility of the object (22) and thereby avoid any collision or contact with the object (22).

Figure 10:
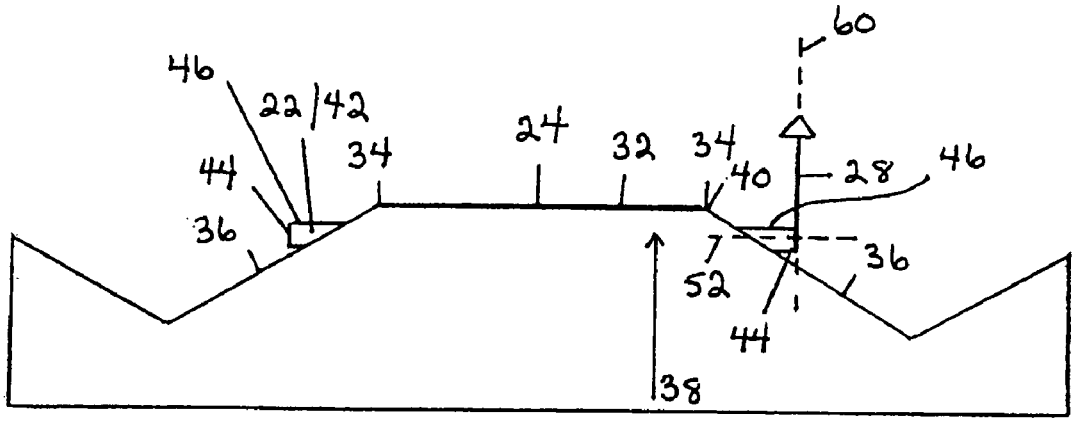
FIG. 10 is a schematic representation of a highway showing the preferred placement of a highway marker device and connection with an object, particularly a culvert.

In the preferred embodiment for use in North America, vehicles utilizing the highway (24) travel or move in a direction of travel on the highway as indicated by reference number (38). The object (22) to be marked is located adjacent, at or in close proximity to one of the sides or edges (34) of the road surface (32) of the highway (24). Although the marker device (20) may be configured or adapted for placement on either side or edge (34) of the highway (24) relative to the direction of travel (38) of the vehicles thereon, the marker device (20) is preferably adapted and provided for placement adjacent the right side or edge (40) of the highway (24) relative to the direction of travel (38) as shown in FIG. 10. However, if desired, the marker device (24) may alternately be configured for placement on the opposed side or edge (34) such as may be required for use of the marker device (20) in the United Kingdom or elsewhere.

Further, the object (22) to be marked by the marker device (20) may be any type, manner or kind of object, thing or structure which is desired to be rendered more visible or observable from the highway (24). Preferably, the object (22) is of a type or kind which is typically installed or affixed adjacent, near or in relatively close proximity to the highway (24). In the preferred embodiment, the object (22) is comprised of a culvert (42) or other drain, channel or passage extending under the highway (24).

Specifically, as shown in FIG. 10, the object (22) is comprised of the culvert (42) which defines an inner surface (43) and has at least one end (44) or opening thereof which is located adjacent one of the sides or edges (34) of the road surface (32) of the highway (24). In the preferred embodiment, one end (44) of the culvert (42) is located or positioned adjacent, at or in proximity to the right side (40) of the road surface (34) such that the marker device (20), when connected with the culvert (42) as described in detail below, is located adjacent the right side or edge (40) of the road surface (32) relative to the direction of travel (38).

The marker device (20) is preferably connected with the culvert (42) at the end (44) thereof to mark the location of the culvert (42) adjacent the right side (40) of the highway (24) relative to the direction of travel (38) of vehicles on the highway (24). Although the marker device (24) may be connected with the culvert (42) at any position about the perimeter or circumference of the end (44), the marker device (20) is preferably connected with the culvert (42) at an uppermost location (46) in the perimeter or circumference of the end (44) nearest the road surface (32). Further, as described in further detail below, the marker device (20) is preferably connected within the inner surface (43) of the culvert (42) at the uppermost location (46) of the circumference of the end (44).

Where the highway (24) has a relatively low grade (36), the end (44) in the culvert (42) will typically be positioned relatively close or near to the road surface (32). As a result, the culvert (42) may be more readily contacted by a vehicle on the highway (24) such as a snow plough clearing snow from the road surface (32). Typically, the snow plough includes a blade which defines a wing which extends outwardly from the right side of the snow plough towards the right side (40) of the highway (24) such that the snow may be cleared or pushed into the ditch adjacent the right side (40) of the highway (24). Accordingly, the wing of the snow plough blade may accidentally contact or collide with the culvert (42) during snow removal operations. The marker device (20) is therefore connected with the culvert (42) to mark the location of the culvert (42) for the operator of the snow plough so that a collision may be avoided.

Figure 1:
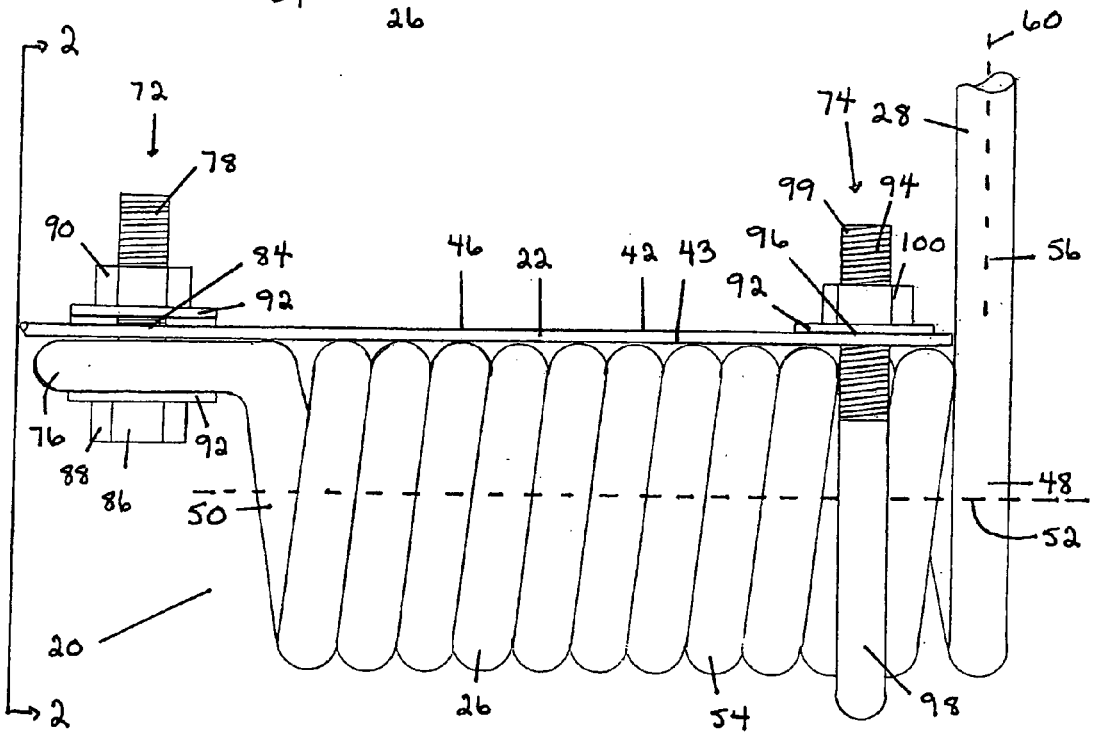
FIG. 1 is a side view of a preferred embodiment of a highway marker device connected with an object shown in section, the marker device comprising a coil spring, a marker post and a mounting mechanism.

As indicated, the highway marker device (20) is comprised of the coil spring (26) as shown in FIGS. 1–9. The coil spring (26) has a first end (48) for connection with the marker post (28) and an opposed second end (50) and defines a spring axis (52) extending therebetween as shown in FIG. 1. Further, the coil spring (26) is comprised of a plurality of windings (54) around the spring axis (52) between the first and second ends (48, 50).

The coil spring (26) may have any number of windings (54) capable of permitting the functioning of the coil spring (26) described herein without readily breaking or failing during use of the marker device (20). Preferably, the coil spring (26) is comprised of at least 9 windings (54). However, the coil spring (26) is comprised of at least 12 windings (54) in the preferred embodiment as shown in FIGS. 1, 3–6 and 8. It has been found that the greater the number of windings (54), the greater the resiliency of the coil spring (26) and the lesser the stress placed on the coil spring (26) during winding or unwinding of the coil spring (26) as described below. As a result, the likelihood of breakage or failure of the marker device (20) upon the use thereof is reduced. Specifically, the number of windings (54) of the coil spring (26) are selected to permit the coil spring (26) to wind or unwind as necessary without breaking under normal or typical use conditions of the marker device (20).

Further, as indicated, the marker post (28) is connected with the first end (48) of the coil spring (26). When the marker device (20) is connected with the object (22) by the mounting mechanism (30) in the manner described below, the coil spring (26) will permit the marker post (28) to give or yield a desired amount. As a result, the likelihood of breaking or snapping of the marker post (28) will be reduced, as will the likelihood of incurring any significant damage to the vehicle contacting the marker device (20).

The plurality of windings (54) of the coil spring (26) may be wound such that the coil spring (26) may tend to either further wind or unwind, as desired, upon contact of the marker post (28) with a vehicle moving in the direction of travel (38) on the highway (24). For instance, as shown in the alternate embodiment of FIGS. 8 and 9, the plurality of windings (54) of the coil spring (26) are wound such that if the marker post (28) is contacted by a vehicle moving in the direction or travel (38), or the marker post (28) is otherwise moved in the direction of travel (38), the coil spring (26) and the windings (54) thereof will tend to unwind.

Figure 6:
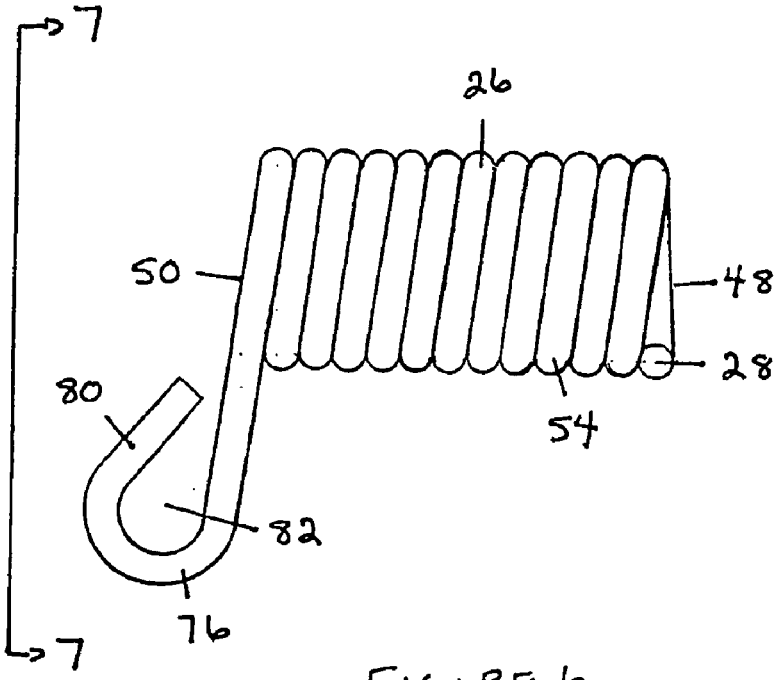
FIG. 6 is a top view of the preferred embodiment of the coil spring of the highway marker device shown in FIG. 1.
Figure 7:
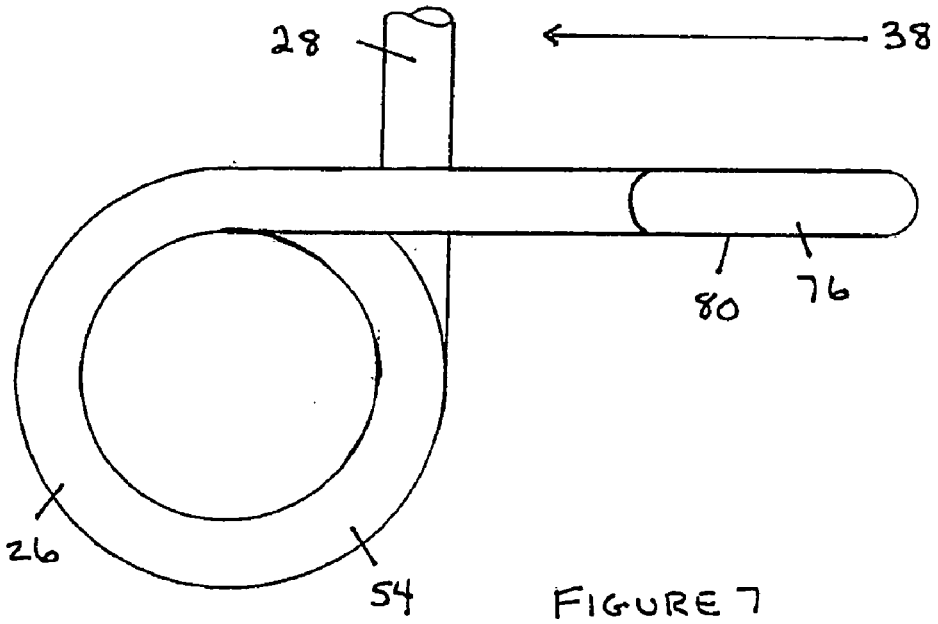
FIG. 7 is an end view of the preferred embodiment of the coil spring shown in FIG. 6, taken along line 7—7 of FIG. 6.
Figure 8:
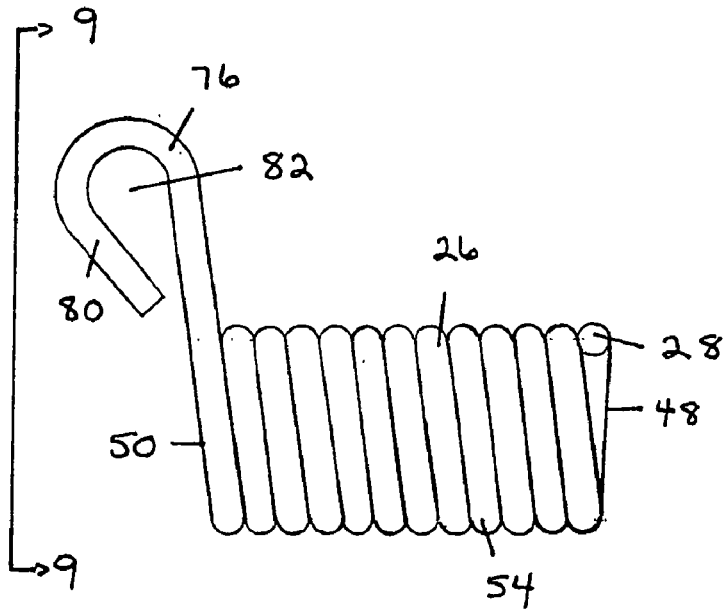
FIG. 8 is a top view of an alternate embodiment of the coil spring of the highway marker device.
Figure 9:
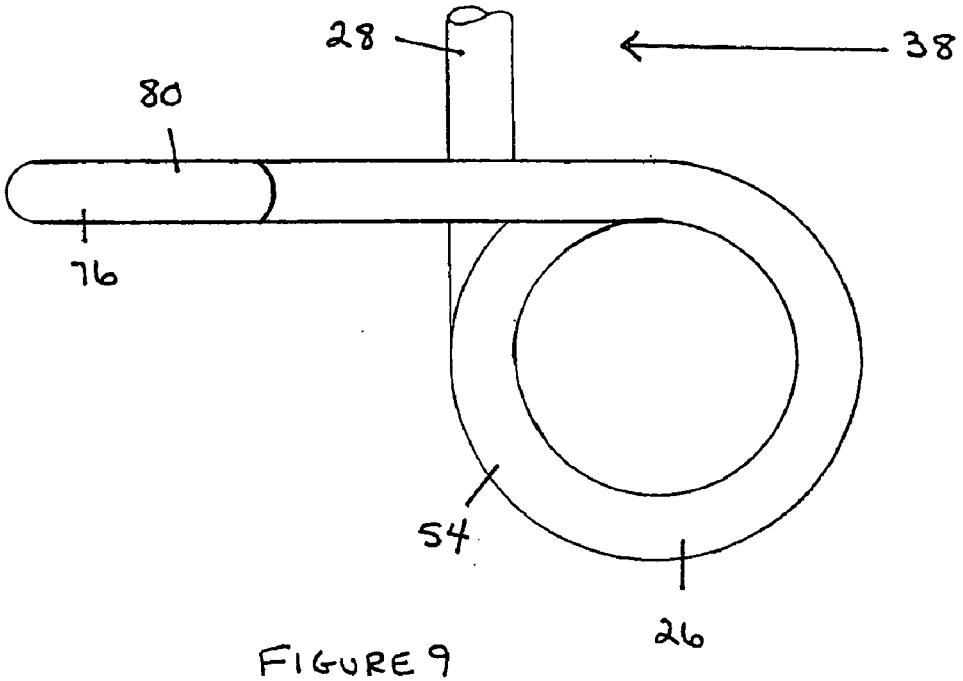
FIG. 9 is an end view of the alternate embodiment of the coil spring shown in FIG. 8, taken along line 9—9 of FIG. 8.

However, in the preferred embodiment as shown in FIGS. 6 and 7, the plurality of windings (54) of the coil spring (26) are wound such that if the marker post (28) is contacted by a vehicle moving in the direction or travel (38), or the marker post (28) is otherwise moved in the direction of travel (38), the coil spring (26) and the windings (54) thereof will tend to become more tightly wound. This manner of winding the coil spring (26) is preferred as it is believed that the coil spring (26) is subjected to less stress when the windings (54) are more tightly wound on movement of the marker post (28) in the direction of travel (38), as compared with unwinding of the coil spring (26) in the alternate embodiment.

The coil spring (26) may be comprised of any suitable material compatible with the intended function of the coil spring (26). However, preferably, the coil spring (26) is comprised of steel, particularly spring steel. In the preferred embodiment, the coil spring (26) is comprised of a steel rod. In addition, the coil spring (26) may have any dimensions compatible with and suitable for the functioning of the coil spring (26) and the marker device (20) as described herein and the mounting mechanism (30) to be utilized for connecting the marker device (20) with the object (22). In the preferred embodiment, the size and dimensions of the coil spring (26) are selected to permit the connecting of the marker device (20) within the culvert (42) as previously described utilizing the preferred embodiment of the mounting mechanism (30). In the preferred embodiment, the coil spring (26) has an outer diameter of at least about fifty millimeters and is comprised of a steel rod having a diameter of between about 10 millimeters and 20 millimeters.

As stated, the marker post (28) is connected with the first end (48) of the coil spring (26). More particularly, the marker post (28) has a proximal end (56) and an opposed distal end (58) and defines a post axis (60) extending longitudinally through the marker post (28) between the proximal and distal ends (56, 58). The proximal end (56) of the marker post (28) is connected with the first end (48) of the coil spring (26) such that the post axis (60) is substantially perpendicular to the spring axis (52) as shown in FIG. 1.

Figure 3:
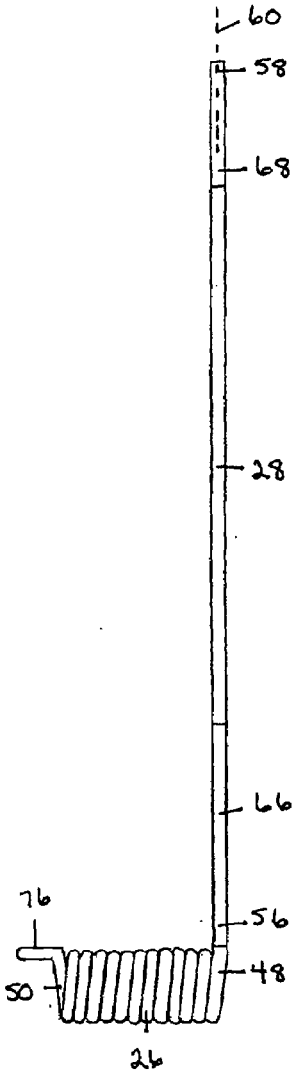
FIG. 3 is a side view of the coil spring and the marker post of the highway marker device shown in FIG. 1, wherein the marker post is integrally formed with the coil spring.

In the preferred embodiment, as shown in FIGS. 1–3, the proximal end (56) of the marker post (28) is fixedly or non-releasably connected with the first end (48) of the coil spring (26). For instance, the proximal end (56) of the marker post (28) may be welded with the first end (48) of the coil spring (26). However, in the preferred embodiment, to enhance the strength of the marker device (20), the marker post (28) is integrally formed with the coil spring (26). In other words, the proximal end (56) of the marker post (28) is integrally formed with the first end (48) of the coil spring (26) such that the coil spring (26) and the marker post (28) provide or comprise an integral or complete unit. In the preferred embodiment, both the coil spring (26) and the marker post (28) are comprised of a single steel rod which is formed into the desired shape or configuration such that the post axis (60) is substantially perpendicular to the spring axis (52).

However, alternatively, where desired or required for any particular use or application, the proximal end (56) of the marker post (28) may be removably or releasably connected with the first end (48) of the coil spring (26). As a result, the marker post (28) may be replaced as necessary or desired for maintenance or repair purposes or to vary the configuration or visibility of the marker post (28) to render it more suitable for a particular use or for particular conditions. Further, the marker post (28) may be interchanged or replaced without requiring the removal of the marker device (20) from the object (22).

Figure 4:
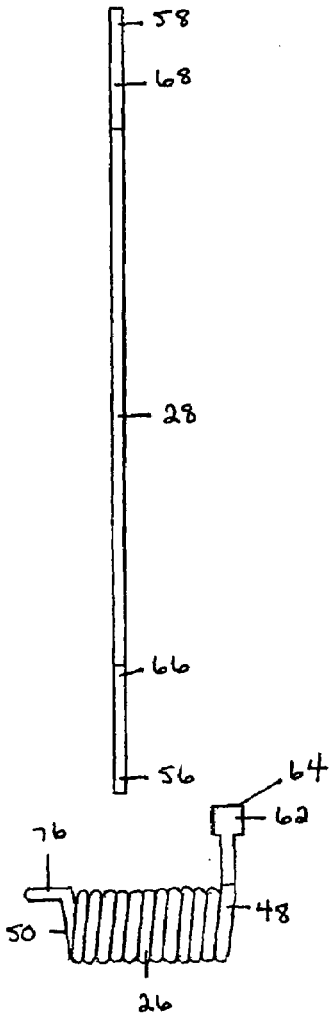
FIG. 4 is a side view of an alternate configuration of the coil spring and the marker post of the highway marker device, wherein the marker post is releasably connectable with the coil spring.

For instance, referring to FIG. 4, the marker device (20) may be further comprised of a connector (62) for connecting, mounting, affixing or fastening the proximal end (56) of the marker post (28) with the first end (48) of the coil spring (26) in the desired orientation. In this case, the connector (62) may be comprised of a separate or distinct element or member which is positioned between and connects or fastens with each of the marker post (28) and the coil spring (26) such the post axis (60) is substantially perpendicular to the spring axis (52). However, preferably in this alternate embodiment, the connector (62) is either integrally formed or fixedly connected with either the first end (48) of the coil spring (26) or the proximal end (56) of the marker post (28). More preferably, as shown in FIG. 4, the connector (62) is preferably fixedly connected by welding or integrally formed with the first end (48) of the coil spring (26).

The connector (62) may be comprised of any mechanism or structure adapted to securely receive and engage the proximal end (56) of the marker post (28), while still permitting the removal or release of the marker post (28) when desired. Preferably, in this alternate embodiment, the connector (62) is comprised of a mounting flange (64) adapted to receive the proximal end (56) of the marker post (28) therein. Thus, the proximal end (56) of the marker post (28) is also adapted or configured to be compatible for receipt in the mounting flange (64). For instance, the mounting flange (64) may comprise a threaded box connector for receiving a compatible threaded pin connector defined by the marker post (28) to provide a threaded connection therebetween. Alternately, the mounting flange (64) may be sized and configured to snugly or closely receive the proximal end (56) of the marker post (28) therein to provide a friction fit therebetween.

The marker post (28) may have any length, as defined by the distance between the proximal and distal ends (56, 58), sufficient to permit the marker post (28), and particularly at least the distal end (58) thereof, to be visible to persons travelling on the highway (24) when the marker device (20) is connected with the object (22). Similarly, the marker post (28) may have any dimensions and configuration on cross-section which permit the marker post (28) to be readily or relatively visible. In the preferred embodiment, the marker post (28) is circular on cross-section and has a diameter of between about 10 millimeters and 20 millimeters.

The marker post (28) may be comprised of any suitable material compatible with the intended function of the marker post (28). For instance, the marker post (28) may be comprised of fibreglass, plastic, wood or metal. However, preferably, the marker post (28) is comprised of steel, particularly spring steel. In the preferred embodiment, the marker post (28) is comprised of a steel rod having a diameter of between about 10 millimeters and 20 millimeters.

Further, the marker post (28) may be coloured or coated as desired to improve the visibility of the marker post (28) or to provide a visible cue or indication of a specific type of object (22) being marked thereby. For instance, at least a portion of the marker post (28) may be brightly coloured in order to enhance its visibility. In this case, one or more colours may be used as desired. Alternately, or in addition, at least a portion of the marker post (28) may be painted with a glow paint or otherwise coated with a luminous or fluorescent coating. Referring to FIGS. 3 and 4, in a preferred embodiment of the marker post (28), a proximal portion (66) of the marker post (28) adjacent the proximal end (56) is preferably yellow in color. The proximal portion (66) may have any desired length, but is preferably about 16 inches (40.64 cm). Further, a distal portion (68) of the marker post (28) adjacent the distal end (58) is preferably fluorescent. The distal portion (68) may also have any desired length, but is preferably about 6–10 inches (15.24–25.4 cm).

Figure 5:
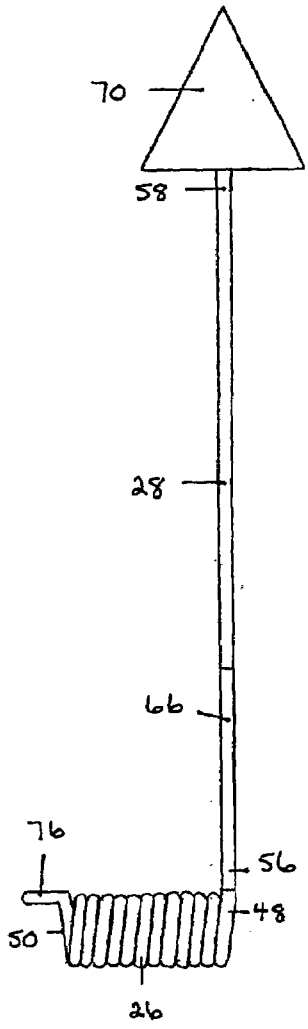
FIG. 5 is a side view of a further alternate configuration of the coil spring and the marker post of the highway marker device, wherein a marker flag is attached to the marker post.

Finally, referring to FIG. 5, where desired, the marker device (20) may be further comprised of a marker flag (70) attached to the distal end (58) of the marker post (28). In this case, the marker flag (70) may be used in place of or to substitute for the distal portion (68). The marker flag (70) may be attached with the distal end (58) in either a fixed or non-removable manner or in a releasable or removable manner as desired. For instance, the marker flag (70) may be fixedly attached with the marker post (28) by welding or integrally formed with the marker post (28). However, preferably, the marker flag (70) is releasably or removably connected with the marker post (28). In this case, the attachment may be provided by any mechanism, structure or fastener capable of, and suitable for, securely connecting, mounting, affixing or fastening the marker flag (70) to the marker post (28) in a releasable manner.

Further, the marker flag (70) may be comprised of any suitable flexible or rigid material and may have any suitable colour and dimensions for enhancing the visibility of the marker device (20). Alternatively or in addition, the marker flag (70) may provide a warning or communicate a desired message to drivers of vehicles on the highway (24).

Finally, as stated, the marker device (20) is comprised of a mounting mechanism (30) for connecting the marker device (20) with the object (22) such that the coil spring (26) is substantially restrained from bending about the spring axis (52). As a result, it is believed that the coil spring (26) is subjected to less stress during use of the marker device (20), particularly upon collision or contact with a vehicle.

Preferably, referring to FIGS. 1 and 2, the mounting mechanism (30) is comprised of a primary mounting mechanism (72) and a secondary mounting mechanism (74). The primary mounting mechanism (72) is located adjacent to the second end (50) of the coil spring (26), being at or in proximity to the second end, while the secondary mounting mechanism (74) is axially spaced along the spring axis (52) relative to the primary mounting mechanism (72) so that the primary mounting mechanism (72) and the secondary mounting mechanism (74) together substantially restrain the coil spring (26) from bending about the spring axis (52). The primary and secondary mounting mechanisms (72, 74) may be spaced apart any distance axially along the length of the coil spring (26) permitting the substantial restraint of the coil spring (26).

As stated, in the preferred embodiment, the primary mounting mechanism (72) is located adjacent to the second end (50) of the coil spring (26). The secondary mounting mechanism (74) may be located axially at any position between the primary mounting mechanism (72) and the first end (48) of the coil spring (26) permitting the primary and secondary mounting mechanisms to substantially restrain the coil spring from bending about the spring axis. Preferably, the secondary mounting mechanism (74) is located adjacent to the first end (48) of the coil spring (26), being at or in proximity to the first end (48). For instance, as shown in FIG. 1, the secondary mounting mechanism (74) may be located at the first end (48). Alternatively, the secondary mounting mechanism (74) may be located in proximity to the first end (48) of the coil spring (26), such as within about 2 to 4 windings (54) of the first end (48), so long as the coil spring (26) is substantially restrained from bending about the spring axis (52).

Thus, in the preferred embodiment, the primary and secondary mounting mechanisms (72, 74) are located adjacent the second and first ends (50, 48) of the coil spring (26) respectively to thereby substantially restrain the coil spring (26) from bending about the spring axis (52).

The primary mounting mechanism (72) is preferably comprised of a mounting bracket (76) positioned adjacent to the second end (50) of the coil spring (26). The mounting bracket (76) may be releasably or removably connected or fastened with the second end (50) of the coil spring (26). However, preferably, the mounting bracket (76) is fixedly or non-releasably connected, fastened or formed with the second end (50) of the coil spring (26). For instance, the mounting bracket (76) may be fixedly connected with the second end (50) of the coil spring (26) by welding. However, in the preferred embodiment, to enhance the strength of the marker device (20), the mounting bracket (76) is integrally formed with the coil spring (26). In other words, the mounting bracket (76) is integrally formed with the second end (50) of the coil spring (26) such that the coil spring (26) and the mounting bracket (76) provide or comprise an integral or complete unit. In the preferred embodiment, both the coil spring (26) and the mounting bracket (76) are comprised of a single steel rod which is formed into the desired shape or configuration.

The mounting bracket (76) may be comprised of any material suitable for and compatible with its intended function. However, preferably, the mounting bracket (76) is comprised of steel, such as spring steel. In the preferred embodiment, as discussed above, the coil spring (26), the marker post (28) and the mounting bracket (76) are all integrally formed from a single piece of steel rod. Although the steel rod may have any suitable dimensions compatible with the intended use of the marker device (20), as stated above, the steel rod preferably has a diameter of between about 10 millimeters and about 20 millimeters.

Further, the primary mounting mechanism (72) is also preferably comprised of at least one fastener (78) for releasably or removably connecting the mounting bracket (76), and thus the marker device (20), with the object (22). The fastener (78) is provided so that the marker device (20) may be relatively easily or readily removed or disconnected from the object (22). In the preferred embodiment, the mounting bracket (76) is configured to form a loop (80) defining an opening or orifice (82) therein as shown in FIG. 6. The fastener (78) is secured in position such that the fastener (78) extends through the object (22) and the orifice (82) defined by the loop (80) in order to secure or connect the mounting bracket (76) with the object (22). In the preferred embodiment, the object (22), being a culvert (42), defines a primary opening (84) or orifice therein which is sized to be compatible for passage of the fastener (78) therethrough. The primary opening (84) is defined in the uppermost location or position (46) about the circumference of the culvert (42) to permit the connection of the marker device (20) at the preferred location on the culvert (42) as described above.

The fastener (78) may be comprised of any mechanism, structure or device capable of connecting the mounting bracket (76) with the object (22) such as a screw or bolt. However, in the preferred embodiment as shown in FIGS. 1 and 2, the fastener (78) is comprised of a threaded bolt (86) having a bolt head (88) and compatible threaded nut (90) for connecting or affixing the mounting bracket (76) with the object (22). Specifically, the mounting bracket (76) is placed within the culvert (42) to abut against the inner surface (43) of the culvert (42) such that the opening (82) defined by the loop (80) is aligned with the primary opening (84) in the culvert (42). The bolt (86) is passed through the opening (82) defined by the loop (80) and the primary opening (84) in the culvert (42) from either within or outside of the culvert (42) and secured in position by the nut (90). As shown in FIGS. 1 and 2, the bolt head (88) is secured against the loop (80) while the nut (90) is secured against the culvert (42), although the reverse placement is also permitted. Finally, one or more washers (92) may be provided where desired or required to facilitate the fastener (78).

Additionally, the mounting bracket (76) may be connected or integrally formed with the coil spring (26) such that the mounting bracket (76) may tend to move away or toward the object (22), as desired, upon contact of the marker post (28) with a vehicle moving in the direction of travel (38) on the highway (24). For instance, as shown in the alternate embodiment in FIGS. 8 and 9, the mounting bracket (76) is integrally formed with the coil spring (26) such that when the marker post (28) is contacted by a vehicle moving in the direction of travel (38) on the highway (24) or the marker post (28) is otherwise moved in the direction of travel (38), the mounting bracket (76) will tend to move away from the object (22). The movement of the mounting bracket (76) away from the inner surface (53) of the culvert (42) is restrained by the fastener (78).

However, preferably, as shown in the preferred embodiment in FIGS. 6 and 7, the mounting bracket (76) is integrally formed with the coil spring (26) such that when the marker post (28) is contacted by a vehicle moving in the direction of travel (38) on the highway (24) or the marker post (28) is otherwise moved in the direction of travel (38), the mounting bracket (76) will tend to move toward or in closer proximity to the object (22). Movement of the mounting bracket (76) in this case is restrained by the abutment of the mounting bracket (76) with the inner surface (43) of the culvert (42) as shown in FIG. 2. It is believed that the coil spring (26) and the primary mounting mechanism (72) are subjected to less stress when the mounting bracket (76) moves toward the object (22) on movement of the marker post (28) in the direction of travel (38), as compared with movement away from the object (22).

The secondary mounting mechanism (74) is also preferably comprised of at least one fastener (94) for releasably or removably connecting the coil spring (26), and thus the marker device (20), with the object (22). The fastener (94) is provided so that the marker device (20) may be relatively easily or readily removed or disconnected from the object (22). In the preferred embodiment, the fastener (94) is secured in position such that the fastener (94) extends about or around the coil spring (26) and through the object (22) in order to secure or connect the coil spring (26) with the object (22). In the preferred embodiment, the object (22), being a culvert (42), defines at least one secondary opening (96) or orifice, and preferably a pair of secondary openings (96), therein which are sized to be compatible for passage of the fastener (94) therethrough. The secondary openings (96) are also defined in the uppermost location or position (46) about the circumference of the culvert (42) to permit the connection of the marker device (20) at the preferred location on the culvert (42) as described above.

The fastener (94) may be comprised of any mechanism, structure or device capable of connecting the coil spring (26) with the object (22) such as a screw or bolt. However, in the preferred embodiment as shown in FIGS. 1 and 2, the fastener (94) is comprised of a U-bolt (98) having threaded ends (99) and a pair of compatible threaded nuts (100) for connecting the U-bolt (98) with the object (22). The U-bolt (98) is sized and configured to surround the coil spring (26).

Specifically, the coil spring (26) is placed within the culvert (42) to abut against the inner surface (43) of the culvert (42) adjacent to and aligned between the secondary openings (96) defined by the culvert (42). The U-bolt (98) is placed about the coil spring (26) such that the coil spring (26) is partially enclosed or surrounded thereby and such that the ends (99) of the U-bolt (98) pass through the secondary openings (96) in the culvert (42). The U-bolt (98) is then secured in position by the nuts (100). As shown in FIGS. 1 and 2, the nuts (100) are secured against the outside surface of the culvert (42). However, one or more washers (92) may be provided where desired or required to facilitate the fastener (94).

Finally, in the preferred embodiment, the marker device (20) is adapted to be connected with the object (22) so that the spring axis (52) is substantially perpendicular to the direction of travel (38) on the highway (24). More preferably, the marker device (20) is adapted to be connected with the object (22) so that the spring axis (52) is substantially horizontal.

This arrangement is provided for in the preferred embodiment. Specifically, as shown in FIG. 10, the culvert (42) typically extends under the road surface (32) in an orientation which is substantially perpendicular to the direction of travel (38) and is further oriented such that the end (44) of the culvert (42) extends from under the road surface (32) substantially horizontally. Thus, the connection of the marker device (20) to the inner surface (43) of the culvert (42) as described above using the primary and secondary mounting mechanisms (72, 74) results in an orientation of the spring axis (52) which is both substantially perpendicular to the direction of travel (38) and substantially horizontal.

However, if required, the orientation of the spring axis (52) may be adjusted to the horizontal by placing one or more adjustment blocks or members (not shown) between either or both of the mounting bracket (76) and the culvert (42) and the coil spring (26) and the culvert (42) preferably adjacent the U-bolt (98). Further, if required, the orientation of the spring axis (52) may be adjusted to be perpendicular to the direction of travel (38) by forming the primary and secondary openings (84, 96) in the culvert (42) at a location to achieve this orientation.

The embodiments of the invention in which an exclusive property or privilege is:

1. A highway marker device for marking the location of an object located adjacent to a highway, the device comprising:

(a) a coil spring having a first end and a second end, wherein the coil spring is comprised of a plurality of windings around a spring axis;

(b) a marker post connected with the first end of the coil spring, wherein the marker post has a post axis and wherein the post axis is substantially perpendicular to the spring axis; and (c) a mounting mechanism for connecting the device with the object such that the coil spring is substantially restrained from bending about the spring axis, wherein the mounting mechanism is comprised of a primary mounting mechanism and a secondary mounting mechanism and wherein the secondary mounting mechanism is axially spaced along the spring axis relative to the primary mounting mechanism so that the primary mounting mechanism and the secondary mounting mechanism together substantially restrain the coil spring from bending about the spring axis.

2. The device as claimed in claim 1 wherein the primary mounting mechanism is comprised of a mounting bracket located adjacent to the second end of the coil spring.

3. The device as claimed in claim 2 wherein the primary mounting mechanism is integrally formed with the coil spring.

4. The device as claimed in claim 2 wherein the secondary mounting mechanism is comprised of a U-bolt which is sized to surround the coil spring.

5. The device as claimed in claim 4 wherein the secondary mounting mechanism is further comprised of a pair of nuts for connecting the U-bolt with the object.

6. The device as claimed in claim 5 wherein the secondary mounting mechanism is located adjacent to the first end of the coil spring.

7. The device as claimed in claim 2 wherein the marker post is integrally formed with the coil spring.

8. The device as claimed in claim 2, further comprising a marker flag attached to the marker post.

9. The device as claimed in claim 2 wherein at least a portion of the marker post is brightly coloured in order to enhance its visibility.

10. The device as claimed in claim 2 wherein at least a portion of the marker post is coated with a luminous coating.

11. The device as claimed in claim 2 wherein the device is adapted to be connected with the object so that the spring axis is substantially perpendicular to a direction of travel on the highway.

12. The device as claimed in claim 11 wherein the device is adapted to be connected with the object so that the spring axis is substantially horizontal.

13. The device as claimed in claim 11 wherein the plurality of windings of the coil spring are wound such that if the marker post is contacted by a vehicle moving in the direction of travel on the highway, the coil spring will tend to become more tightly wound.

14. The device as claimed in claim 11 wherein the mounting bracket is connected with the coil spring such that if the marker post is contacted by a vehicle moving in the direction of travel on the highway, the mounting bracket will tend to move toward the object.

15. The device as claimed in claim 2 wherein the coil spring is comprised of at least 9 windings.

16. The device as claimed in claim 15 wherein the coil spring is comprised of at least 12 windings.

17. The device as claimed in claim 2 wherein the coil spring, the marker post and the mounting bracket are integrally formed from a single piece of steel rod.

18. The device as claimed in claim 17 wherein the steel rod has a diameter of between about 10 millimeters and about 20 millimeters.

19. The device as claimed in claim 17 wherein the coil spring has an outer diameter of at least about fifty millimeters.

20. The device as claimed in claim 17 wherein the secondary mounting mechanism is comprised of a U-bolt which is sized to surround the coil spring.

21. The device as claimed in claim 20 wherein the secondary mounting mechanism is located adjacent to the first end of the coil spring.

22. The device as claimed in claim 21 wherein the secondary mounting mechanism is further comprised of a pair of nuts for connecting the U-bolt with the object.

* * * * *